United States Patent [19]

Fukumoto et al.

[11] Patent Number: 4,878,772

[45] Date of Patent: Nov. 7, 1989

[54] THERMAL TRANSCRIPTION PRINTER

[75] Inventors: Hiroshi Fukumoto; Koji Namura, both of Amagasaki; Kenichi Naruki; Ryuzo Une, both of Fukuyama, all of Japan

[73] Assignee: Mitsubishi Denki Kabushiki Kaisha, Tokyo, Japan

[21] Appl. No.: 226,931

[22] Filed: Aug. 1, 1988

[30] Foreign Application Priority Data

Aug. 8, 1987 [JP] Japan ..... 62-198560

[51] Int. Cl.[4] ..... B41J 3/02; B41J 13/02

[52] U.S. Cl. ..... 400/120; 400/636.3

[58] Field of Search ..... 400/120, 636, 641, 617, 400/611, 636.3; 101/232

[56] References Cited

U.S. PATENT DOCUMENTS

| | | | |
|---|---|---|---|
| 4,625,218 | 11/1986 | Watanabe | 400/120 |
| 4,739,341 | 4/1988 | Matsuno et al. | 400/120 |
| 4,754,290 | 6/1988 | Kitayama et al. | 400/120 |
| 4,781,113 | 11/1988 | Yamamoto et al. | 400/120 |

*Primary Examiner*—Eugene H. Eickholt

*Attorney, Agent, or Firm*—Sughrue, Mion, Zinn, Macpeak and Seas

[57] ABSTRACT

A thermal transcription printer has a thermal head (8), a platen (9), a pair of pinch rollers (10), (11) disposed on both side of the platen and a pressure control device, consisting of cams (35), sliding blocks (31) and springs (32), (33) and (36) and the cams controls pressing force of a pinch roller disposed backward of paper conveying direction smaller than that disposed forward for making the paper sheet (3) closely adhere to the platen (9).

4 Claims, 11 Drawing Sheets

THERMAL TRANSCRIPTION PRINTER

FIELD OF THE INVENTION AND RELATED ART STATEMENT

1. FIELD OF THE INVENTION

The present invention relates to a thermal transcription printer in which ink on a ribbon is transcribed to a paper sheet to be recorded an image or the like by heating of a thermal head, especially relates to a thermal transcription printer which repeats transcription of images plural times on the same area by reciprocation of the paper.

2. DESCRIPTION OF THE RELATED ART

FIG. 20 shows a conventional thermal transcription printer, for example, shown in Japanese published unexamined patent application Sho 60-72773. In FIG. 20, a paper sheet 3 contained in a cassette 2, which is removably fitted with a body 1, is supplied one by one to a platen 9 by rotation of paper supplying rollers 4 (for simplifying the illustration, only one is schematically shown in the figure). A ribbon 7 which is to be thermally transcribed to the paper sheet 3 is supplied from a supplying spool 5 to a withdrawing spool 6. A thermal head 8 is moved up and down by magnetic energy of a magnet 12. One or more insertion pinch roller 11 disposed on an insertion portion of the platen 9 and one or more ejection pinch roller 10 disposed on an ejection portion of the platen 9 are respectively pressed on a surface of the platen 9 by springs (not shown in the figure) and rotated by the rotation of the platen 9 (only one of the pinch rollers 10 and 11 are schematically shown in the figure for simplifying). An friction member 13 and brake 14 are disposed above the insertion pinch roller 11. And aligning rollers 15 and 16 are also disposed above the insertion pinch roller 11. Ejection roller 17, ejection pinch roller 18 and a pair of ejection paper guides 24 and 25 are disposed above the ejection pinch roller 10. Only one of the ejection rollers 17 and ejection pinch rollers 18 are schematically shown in the figure for simplifying. At the bottom of the ejection paper guides 24 and 25, a sensor 19 for detecting the top of the paper sheet 3 is disposed. The paper sheet 3 supplied from the cassette 2 is guided by paper guides 20 and 21. A stacker 26, a power supply 27 and control circuit substrates 28 are also disposed on the body 1.

A paper sheet 3 which is supplied from the cassette 2 passes a space between the paper guides 20 and 21, forwarded by the rotation of the aligning rollers 15 and 16 and inserted to a space between the platen 9 and the insertion pinch roller 11. Thereafter, the paper sheet 3 passes between the platen 9 and the ejection pinch roller 10 being sandwiched by the platen 9 and the ribbon 7, and reaches a position facing to the sensor 19.

When the sensor 19 detects the top of the paper sheet 3, the magnet 12 is excited to push the thermal head 8 to the platen 9, sandwiching the paper sheet 3 and the ribbon 7 therebetween. By supplying electric signals to the thermal head 8, selected parts of ink on the ribbon 7 at reception of heat from the thermal head 8, and an image to be formed is transcribed to the paper sheet 3. When the transcription of the image to the paper sheet 3 is completed, the thermal head 8 is removed from the platen 9 by stopping the excitation of the magnet 12, and the paper sheet 3 is conveyed backward to the position facing the sensor 19, by rotation of the platen 9 and the pinch rollers 10 and 11.

The used part of the ribbon 7 is wound by the withdrawing spool 6, and then a ribbon 7 of another color is superposed to the paper sheet 3 and the transcription of image of said another color is made on the paper sheet 3 by the same process. After repeating the above-mentioned transcription process in necessary number of times for various colors, the paper sheet 3 is ejected to the stacker 26.

As the conventional thermal transcription printer is constituted as mentioned above, speed difference is often made between different parts of driving means for the paper sheet 3. That is, the paper conveying speeds at an insertion part defined by the insertion pinch roller 11 and the platen 9 is different from the paper conveying speed at an ejection part defined by the ejection pinch roller 10 and the platen 9 during the reciprocation conveyances of the paper sheet 3. As a result, looseness or slippage of the paper sheet 3 is between the part of insertion pinch roller 11 and the part of the ejection pinch roller 10 and of the position of the paper sheet 3 with regard to the rotation angle of the platen 9 occurs. Those disadvantages are the cause of the color breakup of the printed color images on the paper sheet 3.

And also, when the pressures of each pinch rollers are not uniform, the paper sheet 3 is conveyed obliquely. The obliqueness of the paper sheet 3 is different in forward and backward conveyances. As a result, the color breakup may occur.

Furthermore, in forward conveyance of the paper sheet 3 (for transcription of the image) the thermal head 8 is pressed on the platen 9, while in backward conveyance of the paper sheet 3 the thermal head 8 is departed from the platen 9. Because the conditions of the paper conveyances in forward and backward directions are different from each other the above-mentioned misregestration is liable to occur.

OBJECT AND SUMMARY OF THE INVENTION

Object of the present invention is to provide an improved thermal transcription printer capable of solving the above-mentioned conventional disadvantages, wherein a paper is closely adhered to a platen both in forward and backward conveyances, and the paper is conveyed on a contacting surface of the platen without slippage therefrom.

A thermal transcription printer in accordance with the present invention comprises;

- a thermal head for supplying heat energy to an ink ribbon pressed on a paper to be transcribed of an image;
- a platen whereon said paper is to be wound and reciprocatively conveyed by clockwise and counterclockwise rotations whereof;
- a pair of pinch rollers disposed with pressing forces onto insertion side and ejection side of the platen for pressing the paper to the platen; and
- a pressure control means for changing pressing of the pinch rollers, in a manner that pressing force of the pinch roller of backward position with respect to a conveyance direction of the paper is smaller than that of the forward position.

Since the thermal transcription printer in accordance with the present invention is constituted as mentioned above, the paper is conveyed forward and backward closely adhered and looseness or slippage from the platen is prevented. As a result, a color image is accurately an clearly transcribed to the paper without occurrence of misregistration.

BRIEF DESCRIPTON OF THE DRAWINGS

DESCRIPTION OF THE PREFERRED EMBODIMENTS

Figure 1:
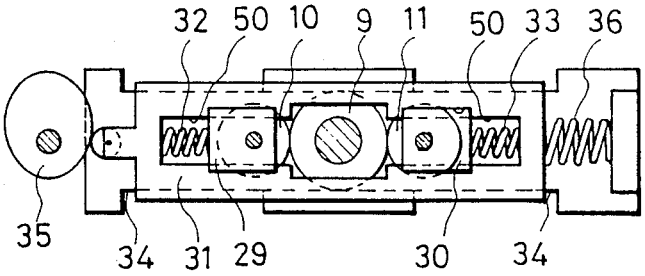
FIG. 1 is a side view showing main part of a preferred embodiment of a thermal transcription printer in accordance with the present invention.
Figure 2:
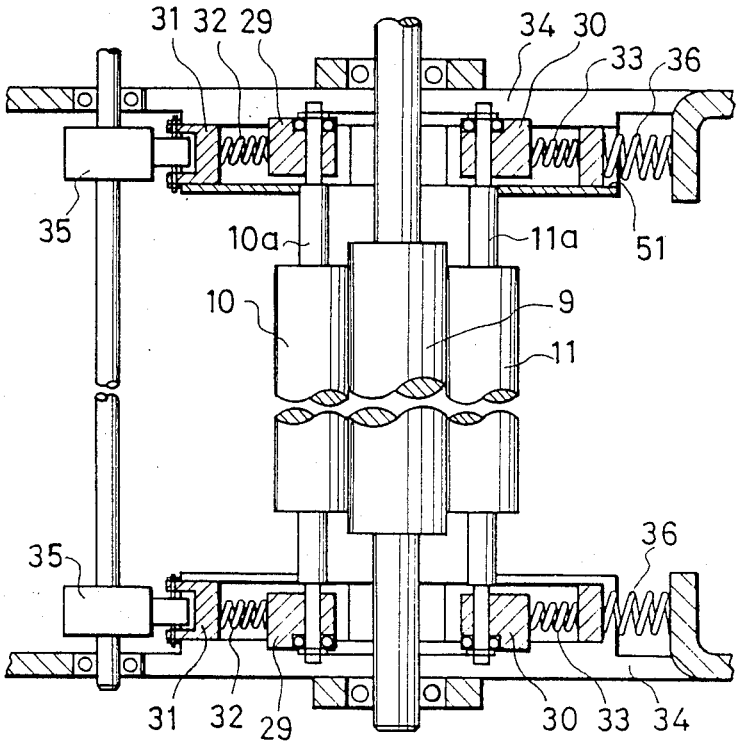
FIG. 2 is a partial cross-sectional plan view showing the main part of the thermal transcription printer shown in FIG. 1.
Figure 3:
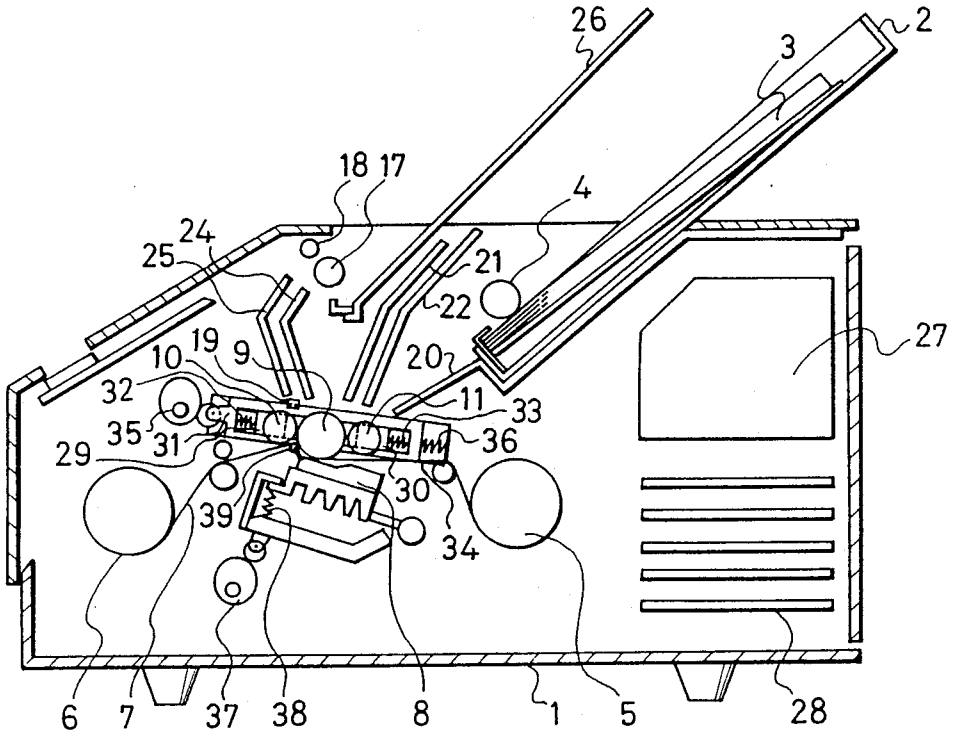
FIG. 3 is a cross-sectional side view showing whole of the preferred embodiment of the thermal transcription printer in accordance with the present invention.

A preferred embodiment of a thermal transcription printer is described in reference to FIG. 1, FIG. 2 and FIG. 3.

FIG. 1 is a side view showing the main part of the thermal transcription printer in accordance with the present invention. FIG. 2 is a partial cross-sectional plan view of the thermal transcription printer shown in FIG. 1. FIG. 3 is a cross-sectional side view showing the whole constitution of the thermal transcription printer shown in FIG. 1 and FIG. 2.

In FIG. 3, a cassette 2 for containing paper sheets 3 to which color image is to be transcribed is mounted on a body 1. The paper sheet 3 is supplied to an image transcription part by the rotation of paper supplying rollers 4. (In actual apparatus, there are provided several rollers, but for simplifying the illustration, only one is schematically shown in the figure). A ribbon 7 which is to be thermally transcribed to the paper sheet 3 is supplied from a supplying spool 5 to a withdrawing spool 6. A thermal head 8 is moved up and down by a rotation of a head control cam 37 and contacts with a platen 9. Pressure of the thermal head 8 to the platen 9 is supplied by a head pressing spring 38. A removal roller 39 is disposed above the top surface of the thermal head 8 for removing the ribbon 7 from the thermal head 8 when the thermal had 8 is departed from the platen 9. A pair of pinch rollers 10 and 11 are disposed on both sides (ejection part and insertion part) of the platen 9, which contact with the platen 9 by pressures supplied from the springs 32, 33 and 36. Details are described afterward. A paper guide 20 is provided below the cassette 2 and between the cassette 2 and the insertion pinch roller 11. And also a pair of paper guides 21 and 22 are provided above the platen 9 and the insertion pinch roller 11. The paper sheet 3 from the cassette 2 is conveyed to the contact part of the platen 9 and the insertion pinch roller 11 and guided by the paper guides 20 and 22. Another pair of paper guides 24 and 25 are provided above the platen 9 and the ejection pinch roller 10. At the bottom end of the paper guide 24 or 25, a sensor 19 for detecting whether the top end of the paper sheet 3 passes or reaches to a position facing to the sensor 19 or not. An ejection roller 17 and a pinch roller 18 are provided above the top ends of the paper guides 24 and 25. Furthermore, a stacker 26 is disposed nearby the ejection roller 17 and above the platen 9. A power supply 27 and control circuit substrates 28 are disposed in the body 1.

In FIGS. 1 and 2, bearing blocks 29 are disposed on both ends of a shaft 10*a* of the ejection pinch roller 10, and bearing blocks 30 are provided on both ends of a shaft 11*a* of the insertion pinch roller 11. Such bearing blocks 29 and 30 slidably engage in guiding grooves 50 of sliding blocks 31, and slide along the guide grooves 50.

The ejection pinch roller 10 is pressed to the platen 9 by pressure of the springs 32 which are applied to the bearing blocks 29. And the insertion pinch roller 11 is also pressed to the platen 9 by pressure of the springs 33 which are applied to the bearing blocks 30. The sliding blocks 31 respectively slidably engage in guiding grooves 51 of a frame 34 and moves along the guide grooves 51 for balancing the pressure of the springs 36 and the cams 35.

Motion of the above-mentioned embodiment is as follows:

When the platen 9 is stopped as shown in FIG. 1, the cam 35 takes a neutral position so that the strain of the spring 32 is equal to that of the spring 33. At this time, pressure $P_1$ is a boundary pressure of the pinch rollers 10 and 11 for pressing the paper sheet 3 to the platen 9 so as to be conveyed around the platen 9 without any slippage by the rotation of the platen 9.

Figure 4:
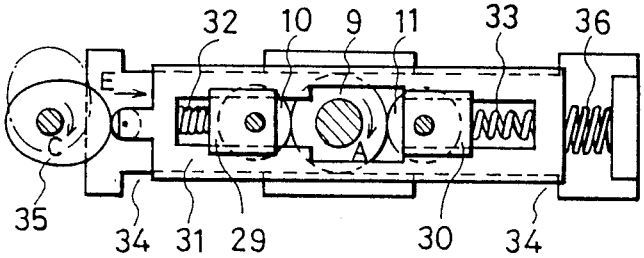
FIG. 4, FIG. 5, FIG. 6, FIG. 7, FIG. 8, FIG. 9, FIG. 10 and FIG. 11 are side views showing motions of the main part of thermal transcription printer shown in FIG. 1.

When the platen 9 rotates in clockwise direction shown by arrow A in FIG. 4, the cam 35 rotates about 90 degrees in clockwise direction shown by arrow C from hitherto neutral position by a reduction gear means or the like (not shown). Therefore, the sliding block 31 moves to a direction shown by arrow E and the strain (or stress) of the spring 32 becomes greater than that of the spring 33. Hereupon, when spring constants of the springs 32 and 33 are equal to each other and a changed value of the pressure of the springs 32 and 33 is set a $\Delta P$, the pressure value of the insertion pinch roller 11 becomes $P_1+\Delta P$ and that of the ejection pinch roller 10 becomes $P_1-\Delta P$.

Figure 5:
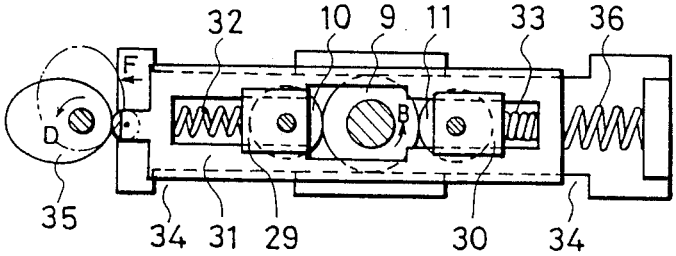

When the platen 9 rotates in counterclockwise direction shown by arrow B in FIG. 5, the cam A35 rotates about 90 degrees in counterclockwise shown by arrow D direction from the neutral position. The sliding block 31 moves to the other direction shown by arrow F and the pressure valve of the insertion pinch roller 11 becomes $P_1\times\Delta P$ and that of the ejection pinch roller 10 becomes $P_1-\Delta P$. By means of such a configuration, the pressure of respective pinch rollers 10 and 11 are changed to predetermined values responding to the reciprocative motion of the paper conveyance.

Figure 6:
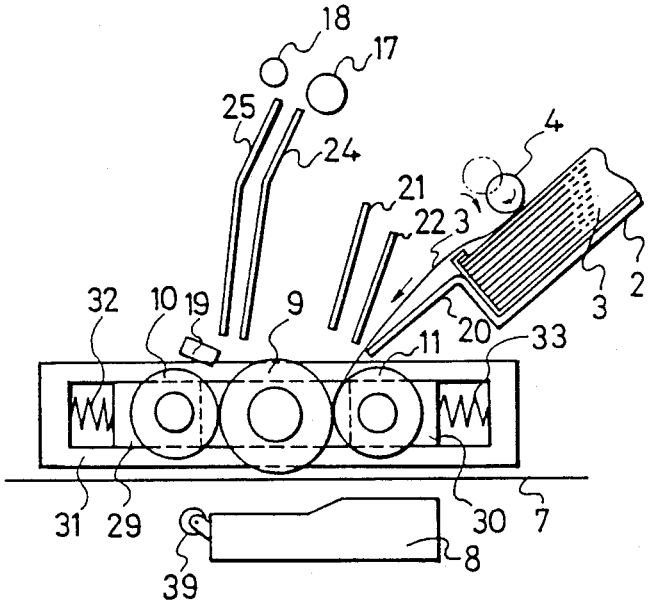

The image transcription operation is described as follows. In FIG. 6, under the condition that thermal head 8 has been down, a paper sheet 3 is supplied from the cassette 2 to a position where the platen 9 and the insertion pinch roller 11 contact with each other by the paper supplying rollers 4. At this time, the platen 9 ceases its rotation and the sliding block 31 is at neutral position.

Figure 7:
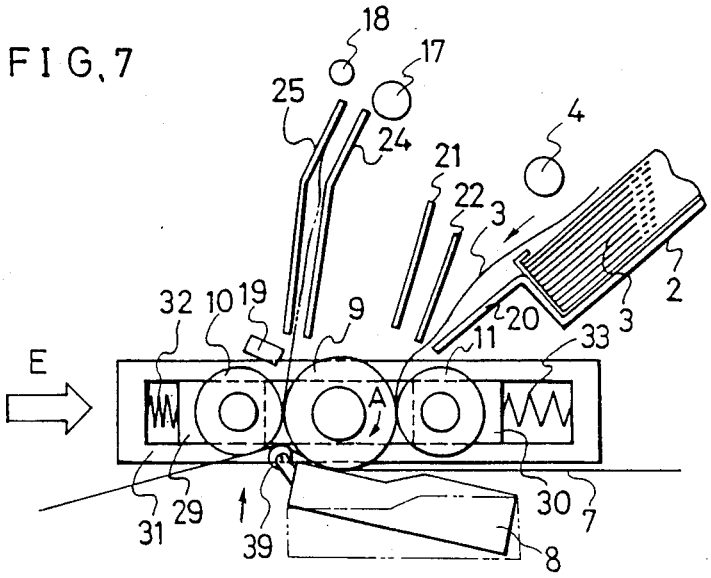

Next, in FIG. 7, when the thermal head 8 goes up and the platen 9 rotates in clockwise direction shown by arrow A, the paper sheet 3 is sandwiched between the platen 9 and the ribbon 7. Then the paper sheet 3 is wound around the platen 9 and ejected from a position where the platen 9 and the ejection pinch roller 10 contact with each other. When the top of the paper sheet 3 reaches to a position facing to the sensor 19, the platen 9 ceases its rotation.

After that, when the thermal head 8 goes down as shown by two-dotted chainline, the platen 9 rotates in clockwise direction as shown by arrow A again and the paper sheet 3 is conveyed a predetermined length. At this time, as the sliding blocks 31 shift in a direction shown by arrow E, the pressure of the insertion pinch roller 11 becomes smaller than that of the ejection pinch roller 10. As a result, the conveying speed due to the ejection pinch roller 10 becomes larger than that due to the insertion pinch roller 11, and the looseness of the paper sheet 3 occurred in supply thereof is gradually removed.

Figure 8:
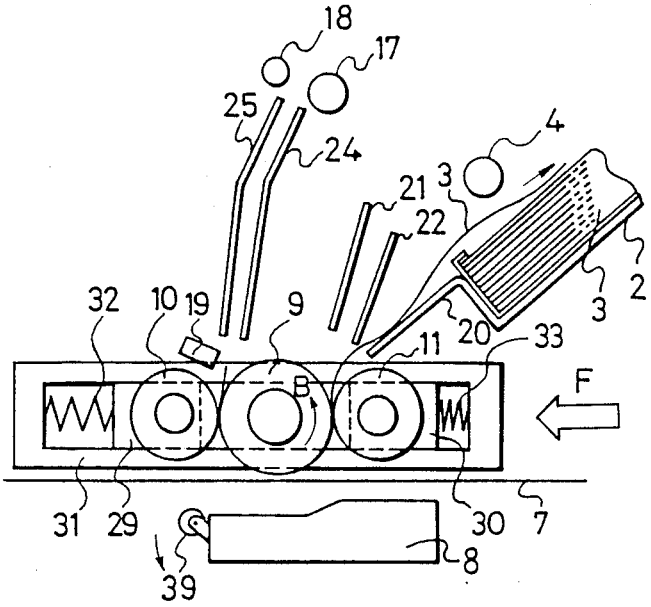

After that, in FIG. 8, the platen 9 is rotated in counterclockwise direction shown by arrow B, for backward conveying the paper sheet 3 until the top of the paper sheet 3 reaches to the position facing the sensor 19. At this time, the sliding blocks 31 shift to the other direction shown by arrow F, and the pressure of the ejection pinch roller 10 becomes larger than that of the insertion pinch roller 11. As a result, the conveying speed due to the insertion pinch roller 11 becomes larger than that due to the ejection pincher roller 10, and hence the looseness of the paper sheet 3 is removed and the paper sheet 3 closely adheres to the platen 9. By the above-mentioned processes, the paper sheet 3 is set to the thermal transcription printer, and the transcription of the image to the paper sheet 3 starts thereafter.

Figure 9:
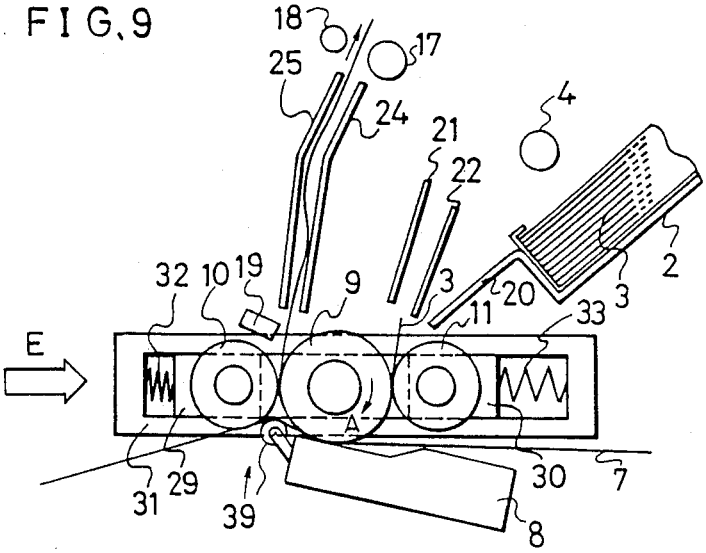

In FIG. 9, a first image transcription of a first color is started after rising up of the thermal head 8 and rotating the platen 9 in clockwise direction shown by arrow A. At this time, the sliding blocks 31 are also shifted in the direction shown by arrow E, for making the pinch rollers 10 and 11 supply previously set pressure.

Figure 10:
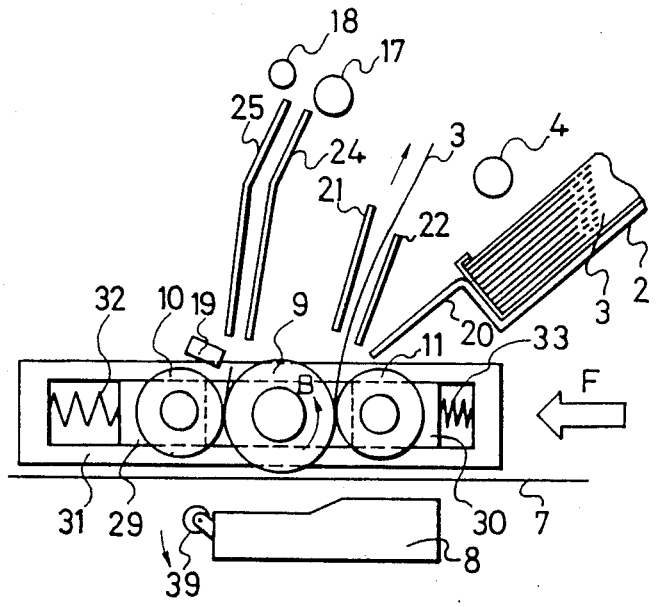

When the first image transcription is over, the thermal head 8 goes down, the platen 9 rotates in counterclockwise direction shown by arrow B and the sliding blocks 31 shift to the direction shown by arrow F as shown in FIG. 10. And the paper sheet 3 is conveyed backward until the top of the paper reaches to the position of facing to the sensor 19. After that, the processes shown in FIGS. 9 and 10 are alternately and plurally repeated for completing all the image transcription of colors.

Figure 11:
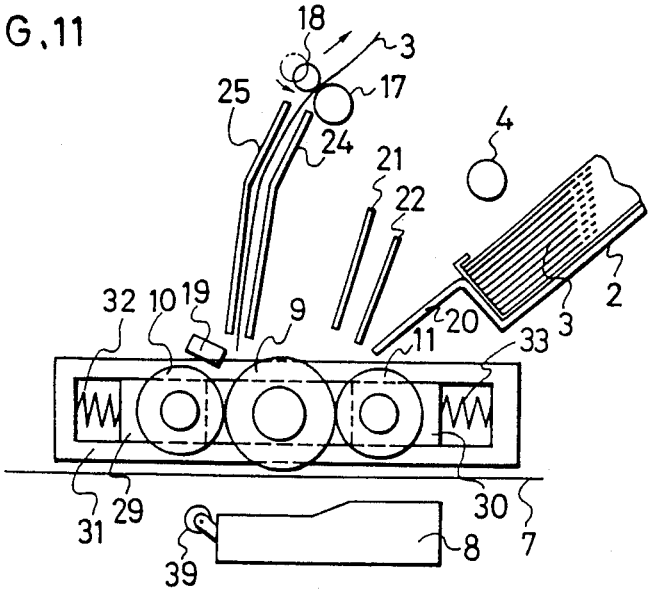

When all the transcriptions of predetermined colors are over, in FIG. 11, the thermal head 8 is put down, the platen 9 is stopped its rotation and the sliding blocks 31 are returned to the neutral position. Then the paper sheet 3 is ejected to the stacker 26 by pressing of the pinch roller 18 to the ejection roller 17 and the rotation thereof.

In the above mentioned embodiment, the pressure $P_B$ of the insertion pinch roller 11 and the pressure $P_F$ of the ejection pinch roller 10 in the image transcription process and the backward conveyance of the paper sheet 3 are shown respectively by the following inequalities.

$P_B$ in the image transcription process is in a range given by $$P_H/e^{82\,\theta} < P_B < P_1,$$

and $P_F$ is in a range given by $$P_1 < P_F < P_H \cdot e^{\mu\theta}$$

$P_B$ in the backward conveyance of the paper sheet is in a range given by $$P_1 < P_B < P_F \cdot e^{2\mu\theta},$$

and $P_F$ is in a range given by $$P_H/e^{\mu\theta} < P_F < P_1.$$

Therein:

$P_H$: pressure of the thermal head 8;

$P_1$: boundary pressure of respective pinch rollers 10 and 11 pressing the paper sheet 3 to the platen 9 so as to convey it around the platen 9 without any slippage by the rotation of the platen 9;

$\theta$: winding angle of the platen 9 for winding the paper sheet 3 between the contacting parts of the platen 9 and respective pinch rollers 10 and 11;

$\mu$: friction coefficient between the outside surface of the platen 9 and the paper sheet 3; and e: base of natural logarithm.

In the above-mentioned embodiment, the paper sheet 3 closely adheres to the platen 9 and conveyed in accordance with the rotation of the platen 9 in forward conveyance (image transcription) operation and backward conveyance operation. Therefore, the looseness or slippage of the paper sheet 3 does not occur, and the error of the positioning of the paper in each image transcription operations does not occur. As a result, a clear color image hardly having color misregistration is formed on the paper sheet 3.

The clear color image having almost no color misregestration is formed by following principles.

Figure 12:
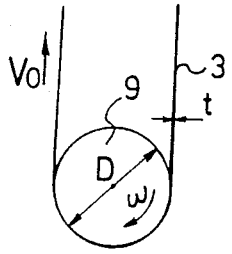
FIG. 12, FIG. 13, FIG. 14, FIG. 15, FIG. 16 and FIG. 17 are schematical side views showing the principles of the present invention.

In FIG. 12, when the paper sheet 3 is wound around the platen 9 with a prescribed tension and the slippage between the paper sheet 3 and the platen 9 does not occur, the conveying speed $V_0$ of the paper sheet 3 is generally provided by the following equation.

$$V_O = (1 + t/D) \cdot V_N.$$

Hereupon, "t" is a thickness of the paper sheet 3, "D" is a diameter of the platen 9, and "$V_N$" is a circumferential velocity of the platen 9. Defining "W" as an angular velocity of the platen 9, the circumferential velocity $V_N$ is given by $$V_N = W \cdot D/2$$

Figure 13:
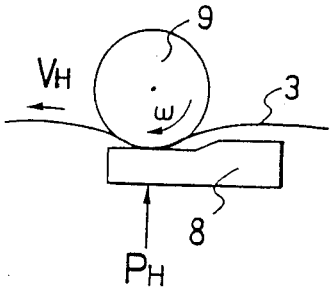

In FIG. 13, when the thermal head 8 presses the platen 9 with sandwiching the paper sheet 3, the conveying speed $V_H$ of the paper sheet 3 at a position where the thermal head 8 presses is affected by the pressure of the thermal head 8. The conveying speed $V_H$ when the paper sheet 3 is sandwiched between the thermal head 8 and the platen 9 with a necessary pressure for image transcribing (which is a rated pressure) is generally larger than $V_O$ due to the deformation of the platen 9 or the like.

Figure 14:
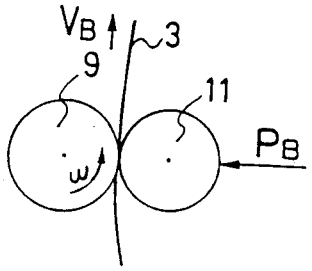
Figure 18:
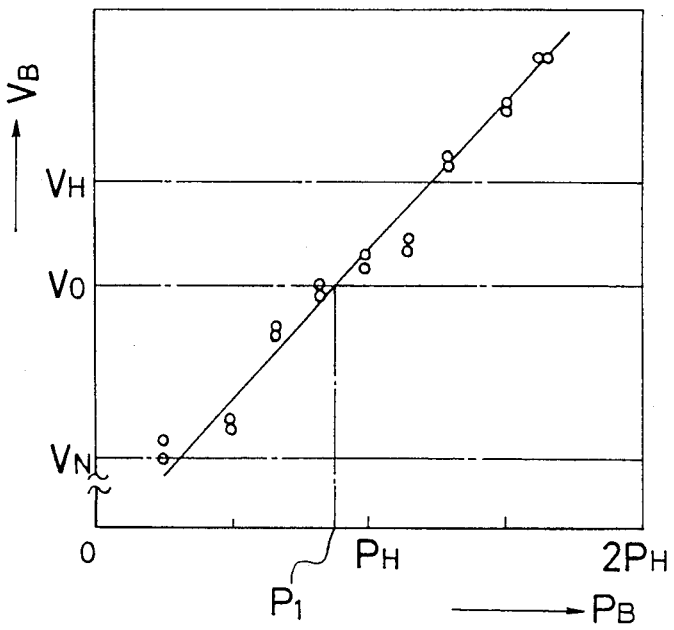
FIG. 18 and FIG. 19 are drawings showing characteristic curves of the paper during conveyance thereof.

On the other hand, as shown in FIG. 14, the conveying speed $V_B$ of the paper sheet 3 increases in proportion to the increase of the pressure $P_B$ of the pinch roller 11 when the paper sheet 3 is pressed to the platen 9 by the pinch roller 11. FIG. 18 is a characteristic curve showing the examples of measured conveying speeds by a solid line. The abscissa of FIG. 18 shows the pressure $P_B$ of the pinch rollers and the ordinate shows the conveying speed $V_B$ of the paper sheet 3. For reference, values of $V_N$, $V_O$, $V_H$ and $P_1$ are shown in FIG. 18.

Figure 15:
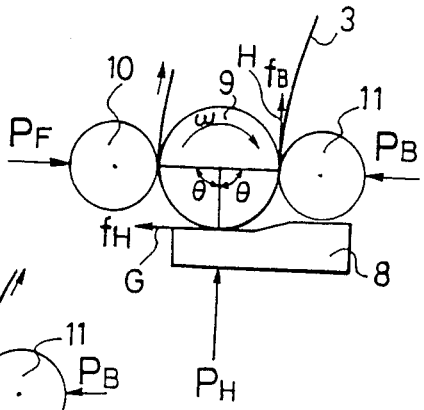

Hereupon, when the pressure $P_B$ of the insertion pinch roller 11 is smaller than the value $P_1$ shown in FIG. 18, the relations among the conveying speeds at each points in the image transcription are provided by the inequality of $$V_B<V_O<V_H$$

and the paper sheet 3 closely adheres to the platen 9 without any looseness. At this time, in FIG. 15, a conveying force $f_H$ due to the thermal head 15 acts in a horizontal direction shown by arrow G, at the position where the thermal head 8 presses the platen 9, and a restriction force $f_B$ acts in a vertical direction shown by arrow H at a position where the insertion pinch roller 11 presses the platen 9.

Figure 17:
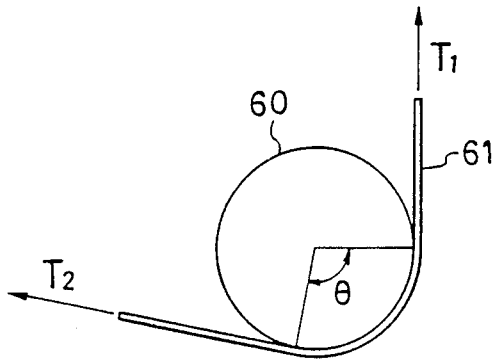

As shown in FIG. 17, when a flexible body 61 is wound around a fixed cylinder 60 taking a winding angle $\theta$, relations among tensions $T_1$ and $T_2$ of the flexible body 61 and a friction coefficient between the flexible body 61 and the outside surface of the cylinder 60 are generally given by the following inequalities.

(i) When an inequality of $$T_1>T_2\cdot e^{\mu\theta}$$

holds, the flexible body 61 slips in a direction shown by arrow $T_1$ on the outside surface of the cylinder 60.

(ii) When an inequality of $$T_1<T_2/e^{\mu\theta},$$

holds, the flexible body 61 slips in a direction shown by arrow $T_2$ on the outside surface of the cylinder 60.

(iii) When an inequality of $$T_2/e^{\mu\theta}<t_1<T_2\cdot e^{\mu\theta}$$

holds, the flexible body 61 is restricted on the outside surface of the cylinder 60 and any slippage can not occur.

When the above-mentioned relations are applied to the embodiment of the present invention, and "$\mu$" is a friction coefficient between the paper sheet 3 and the outside surface of the platen 9, and "$\theta$" is a winding angle by which the paper sheet 3 is to be wound to the platen 9, the following three cases are to be considered;

(iv)

$$f_B>f_H\cdot e^{\mu\theta};$$

(v)

$$0<f_B<(f_H/e^{\mu\theta});$$

and (vi)

$$(f_H/e^{\mu\theta})<f_B<f_H\cdot e^{\mu\theta}.$$

When $f_B$ is kept in a range shown by the inequality (vi), any slippage between the paper sheet 3 and the outside surface of the platen 9 may not occur.

On the other hand, the following equations $$f_H=\mu\cdot P_H;$$

and $$f_B\mu\cdot P_B$$

holds. Therefore, the relations among the pressures shown in the inequality (vi) can be rewritten to an inequality of $$(P_H/e^{\mu\theta})<P_B<P_H\cdot e^{\mu\theta}$$

There is, however, an inequality of $$0<(P_H/e\mu\theta)<P_1<P_H\cdot e^{\mu\theta}$$

holds in practice. Therefore, when the value of $P_B$ is in a range given by an inequality of $$(P_H/e^{82\ \theta})<P_B<P_1,$$

the paper sheet 3 closely adheres to the platen 9 between the portions where the thermal head 8 and the insertion pinch roller 11 respectively contact to the platen 9, and any looseness or slippage may not occur therebetween. Therefore, the paper sheet 3 is conveyed in the conveying speed $V_O$ responding to the rotation of the outside surface of the platen 9.

At this time, it is necessary to prevent the occurrence of the looseness of the paper sheet 3 on the surface of the platen 9 between the thermal head 8 and the ejection pinch roller 10, by setting the conveying speed $V_F$ due to the ejection pinch roller 10 to be larger than the conveying speed $V_O$. Therefore, the pressure $P_F$ should be larger than $P_1$ shown in FIG. 18, and also it should be in a range shown by the following inequality of $$P_1<P_F<P_H\cdot e^{\mu\theta}.$$

Next, in the backward conveyance of the paper sheet 3, the relations among the conveying speeds at each points become shown by the following inequality, by setting that $P_B$ is larger than $P_1$ in FIG. 18 and $P_F$ is smaller than $P_1$, $$V_f<V_O<V_B.$$

Figure 16:
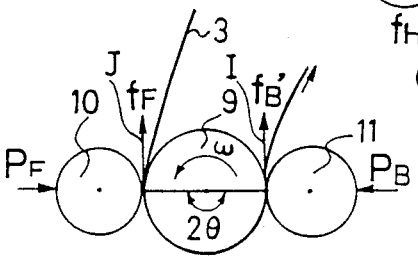

At this time, as shown in FIG. 16, a conveying force $F_B'$ due to the insertion pinch roller 11 acts in a direction shown by arrow I at a position where the insertion pinch roller 11 contacts with the platen 9, and the restriction force $f_F$ due to the ejection pinch roller 10 acts in a direction shown by arrow J at a position where the ejection pinch roller 10 contacts with the platen 9.

When the relation between the conveying force and the restriction force is shown by the following inequality of $$P_H/e^{2\mu\theta}<P_B<P_F\cdot e^{2\mu\theta},$$

similarly to the afore-mentioned image transcription case, the paper sheet 3 closely adheres the platen 9 between the insertion pinch roller 11 and the ejection pinch roller 10, so that any slippage between the platen 9 and the paper sheet 3 does not occur. Therefore, the paper sheet 3 is conveyed in the conveying speed $V_O$.

Figure 19:
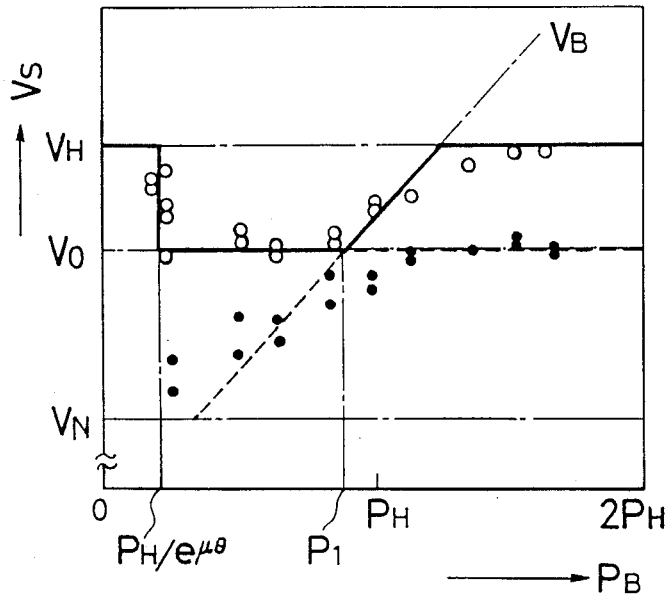
Figure 20:
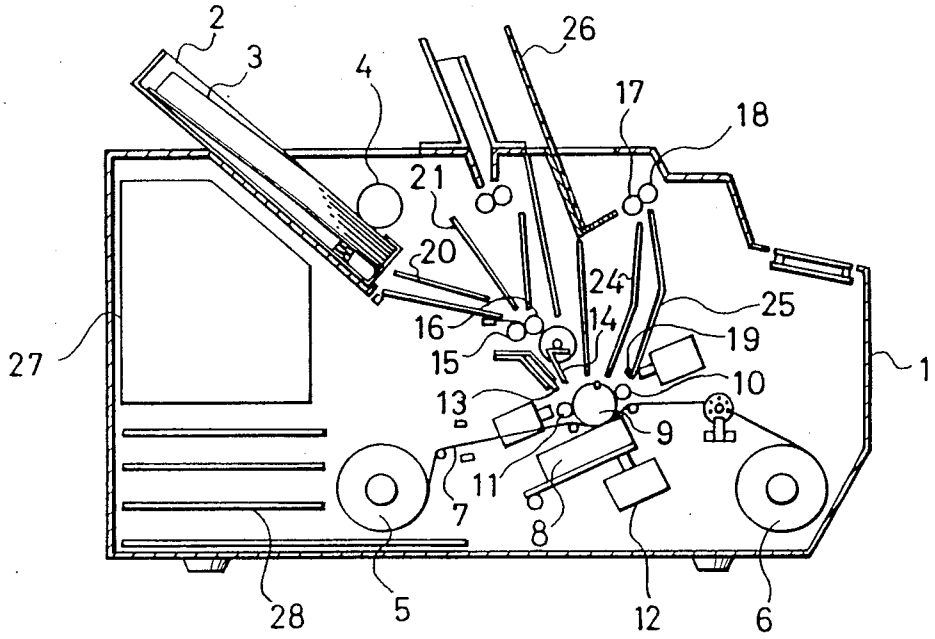
FIG. 20 (Prior Art)
FIG. 20 is a cross-sectional side view showing a conventional thermal transcription printer.

For reference, characteristic curve showing the relation between the pressure $P_B$ of the insertion pinch roller 11 and the conveying speed $V_S$ of the paper in the image transcription is shown by a solid line and that in the backward conveyance of the paper sheet 3 is shown by a dotted line in FIG. 19. Hereupon, in FIG. 19 the abscissa shows the pressure $P_B$ of the insertion pinch roller and the ordinate shows the conveying speed $V_S$ of the paper sheet 3. At this time, the pressure $P_F$ of the ejection pinch roller 10 is selected in a range given by the afore-mentioned inequality. When the pressure $P_B$ of the insertion pinch roller 11 is in a range given by the afore-mentioned inequality, the conveying speeds of the paper sheet 3 in the image transcription and in the backward conveyance of the paper sheet 3 become substantially equal to $V_O$, and a stable paper conveyance is achieved.

The above-mentioned embodiment is described for a case of an application to a multi-color thermal transcription printer. However, the same effects is obtainable when the present invention is applied to another type of printer.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A thermal transcription printer comprising:

a thermal head for supplying heat energy to an ink ribbon pressed on a paper to be transcribed of an image;

a platen whereon said paper is to be wound and reciprocatively conveyed by clockwise and counterclockwise rotations whereof;

a pair of pinch rollers disposed with pressing forces onto insertion side and ejection side of said platen for pressing said paper to said platen; and a pressure control means for making pressing force of said pinch rollers, in a manner that pressing force of the pinch roller of backward position with respect to a conveyance direction of said paper is smaller than that of the forward position.

2. A thermal transcription printer in accordance with claim 1, wherein said pressure control means comprising;

two pairs of bearing blocks disposed on both end of respective pinch rollers;

bearing springs of the same number as that of said bearing blocks respectively for supplying pressure whereby said pinch rollers are pressed on said platen;

at least one sliding block for holding said bearing blocks and said bearing springs and for changing bearing blocks and said bearing springs and for changing strain of said springs by changing its position;

a sliding block holder having at least one guiding groove in which said sliding block fits and slides;

a cam contacting with said sliding block and rotating in clockwise and counterclockwise directions in accordance with the rotation direction of said plate; and spring for pressing said sliding block to said cam.

3. A thermal transcription printer in accordance with claim 2, wherein rotation direction of said cam is fixed for making pressure of one of said pinch rollers disposed backward against a paper conveying direction of said paper smaller than that of the other disposed forward.

4. A thermal transcription printer in accordance with claims 1, 2 or 3, wherein a pressure ($P_B$) of one of said pinch rollers, which is disposed at a backward position and a pressure $P_F$ of the other of said pinch rollers, which is disposed at a forward position against said paper conveying direction in image transcription, are respectively in ranges given by inequalities of $$(P_H/e^{\mu\theta})<P_B<P_1$$

and $$P_1<P_F<P_H e^{\mu\theta}$$

in said image transcription and $$P_1<P_B<P_F e^{2\mu\theta}$$

and $$(P_B/e^{2\mu\theta})<P_F<P_1$$

in backward conveyance of said paper; therein $P_H$: pressure of said thermal head;

$P_1$: boundary pressure of respective pinch rollers pressing a paper sheet to said platen for conveying said paper sheet around said platen without any slippage by rotation of said platen;

$\theta$: winding angle of said platen for winding said paper between the contacting parts of said platen and respective pinch rollers;

$\mu$: friction coefficient between the outside surface of said platen and said paper; and e: base of natural logarithm.

* * * * *